US005911360A

United States Patent [19]

Schellenberg

[11] Patent Number: 5,911,360

[45] Date of Patent: Jun. 15, 1999

[54] DEEP-DRAWN PLASTIC CUP

[75] Inventor: Walter Schellenberg, Diepoldsau, Switzerland

[73] Assignee: Sandherr Packungen AG, Diepoldsau, Switzerland

[21] Appl. No.: 08/981,220

[22] PCT Filed: May 7, 1996

[86] PCT No.: PCT/CH96/00176

§ 371 Date: Dec. 19, 1997

§ 102(e) Date: Dec. 19, 1997

[87] PCT Pub. No.: WO97/02187

PCT Pub. Date: Jan. 23, 1997

[30] Foreign Application Priority Data

Jul. 4, 1995 [CH] Switzerland ..... 195/95

[51] Int. Cl.[6] ..... B65D 1/40; B65D 25/20

[52] U.S. Cl. ..... 229/404; 40/324; 206/459.5; 220/672; 220/675; 229/400

[58] Field of Search ..... 229/400, 403, 229/404; 220/669, 672, 675; 40/324; 206/459.5

[56] References Cited

U.S. PATENT DOCUMENTS

| | | | |
|---|---|---|---|
| 1,744,328 | 1/1930 | Morley | 40/324 |
| 2,554,018 | 5/1951 | Despres | 206/459.1 |
| 3,774,800 | 11/1973 | Lohwasser . | |
| 4,157,762 | 6/1979 | Robinson | 220/669 |
| 4,263,734 | 4/1981 | Bradshaw | 40/324 |
| 4,368,818 | 1/1983 | Day et al. | 229/400 |

FOREIGN PATENT DOCUMENTS

| | | | |
|---|---|---|---|
| 667023 | 11/1965 | Belgium . | |
| 0408515 | 7/1990 | European Pat. Off. . | |
| 1506045 | 12/1967 | France | 220/669 |
| 2 673 161 | 8/1992 | France . | |
| 24 03 935 | 8/1975 | Germany . | |
| 27 38 375 | 3/1979 | Germany . | |
| 30 17 239 | 11/1981 | Germany . | |
| 93/23297 | 11/1993 | Sweden . | |

*Primary Examiner*—Gary E. Elkins
*Attorney, Agent, or Firm*—Randall J. Knuth

[57] ABSTRACT

A deep drawn plastic packaging cup which includes a wall having a bottom, a round cross section wall part being one of cylindrical and truncated-cone shaped, and a round radially protruding outward flanged top rim. A flat wall part extends through a chord of the round cross section of the deep drawn plastic packaging cup wall, and a circulate segment section is formed with the top rim and joined to the flat wall part.

25 Claims, 6 Drawing Sheets

DEEP-DRAWN PLASTIC CUP

BACKGROUND OF THE INVENTION

1. Field of the Invention

The invention relates to a deep-drawn plastic packaging cup.

2. Description of the Related Art

Packaging cups are known in great number and serve, e.g., in the packaging of dairy products, such as yogurt, cottage cheese, sour cream and the like. The objective involved here is to produce such packaging cup, for cost and/or environmental reasons, of a minimal amount of material, that is, with a wall as thin as possible, while nevertheless guaranteeing sufficient stability and/or labelability. Known from EP-B-0 408 515, is a packaging cup whose wall is surrounded by a cardboard sleeve which, by narrow form-fit, is in contact with the plastic part. A disadvantage here is that the cardboard sleeve must be inserted into the mold ready for the fabrication of the packaging cup. The plastic cup is then molded to the cardboard. Furthermore, the cardboard sleeve represents a relatively high material consumption. In turn, this results in the need to produce at the manufacturer's, a correspondingly great number of packaging cups with appropriately changing labeling, and to stock them in keeping with the plurality of goods to be packaged. A correspondingly high stocking is also required at the customer's filling facility.

Known from DE-A-24 03 935, moreover, is a packaging cup whose wall features a flat wall part and an otherwise cylindrical or truncated-cone-like round wall part. The packaging cup has molded to its top rim a flanged rim that protrudes radially outward. Since the flanged rim has along the flat wall part the same width, the packaging cup is relatively unstable in the area of the flat wall part. Furthermore, the packaging cup features in its center area, outside the flat wall part, a shoulder serving as a stacking rest, which imparts a certain stiffness to the packaging cup, but causes a relatively large stacking interval between two adjacent, stacked packaging cups.

SUMMARY OF THE INVENTION

The objective underlying the invention is to create a packaging cup of the initially named type whose strength properties are sufficient while its material consumption is low.

This objective is satisfied by retaining a round flanged rim even along the flat wall part which surprisingly gives a considerable strength of the packaging cup, even with reduced wall thicknesses, thereby, lowering material consumption. The flat wall section lends itself more easily to labeling the packaging cup, e.g., by imprinting or affixing, for example gluing a blank to it, for example a labeling sticker or band. Additionally, it is possible for the labeling to take place not at the manufacturer's of the packaging cup, but at the user's, that is, the filling facility. This creates considerable advantages, since the manufacturer may produce such packaging cups irrespective of subsequent labeling in one style and, consequently, labeling may take place individually at the filling facility. The benefit to both the manufacturer of the packaging cup and the user is considerable economization by inventory reduction and simplified handling. The stable design of the flanged rim, and thus of the flat wall part, also allows a small stacking interval between adjacent nested packaging cups thereby improving stacking and further handling.

The expression "labeling" as used here and hereafter is to be understood in its most general form and is meant to include any kind of notably visual design and decoration and/or marking of the cup contents and/or marking for other references.

The stability of the cup part can be improved by the wall including a reinforcement shoulder. Basically, it is possible for the packaging cup to have a cylindrical basic shape, which may be tapered conically downward, which allows economical stacking of the packaging cup. The stability of the packaging cup allows improvement by a flanged rim having a segment section which features a downward beading, since not only the surrounding round flanged rim contributes considerably to the stability of the packaging cup, but additionally the beading in the segment section between the flat wall part and the flanged rim. A further important advantage is that, between the wall part and the beading, a slot is present that may serve the fixing of a blank to be applied. This improves the fixing of the blank, and also, the stability of the packaging cup.

Especially advantageous is a configuration according to an included transitional shoulder, since this back-off of the flat wall part relative to the round wall part not only improves the stability of the packaging cup, but creates a positive coaction with arrangement of a blank. This improves the stability of the packaging cup further and prevents a jutting out extension, providing for the user a smoother surface, and avoiding protruding edges that might favor an unintended tangling and tear-off of the blank.

Especially favorable is an embodiment of the packaging cup having a base rim that circumscribes a rounded wall port and a bottom portion backed off toward the cup interior, since the configuration of the bottom with a base rim further improves the stability of the packaging cup. The base rim may be present only along the round wall part while the area of the flat wall part is skipped, or, the base rim may extend also in this area.

A further embodiment includes the improvement provides a further stiffening of the packaging cup and notably allows the arrangement of a cap without creating protruding edges. Basically, the base rim may have any cross section, but preferred is a configuration of a rectangular cross section that tapers toward the wall and bottom part, since the taper creates reliefs that allow a locking of parts to be attached, e.g., of a cap and/or a blank, thereby making it possible to secure them without additional means. Additional means, such as one or several sealing spots, can enhance the securing and the stability of the packaging cup.

Especially suitable is an embodiment in which the base rim terminates at the flat wall and includes end faces extending radially to the center axis, notably whenever a single-piece blank is to be arranged both on the flat wall part and the backed-off bottom part.

As previously mentioned, various options of labeling and/or reinforcement are available for the packaging cup, which may be employed individually or in combination with one another. The attachable cap may serve to exclusively improve the strength of the packaging cup or preferably improve labeling utility. However, both objectives may be pursued also simultaneously with the cap. This makes it possible, moreover, to set the filled packaging cup down not on its bottom, but on its top which, for example with a closing membrane sealed to the surrounding flanged rim, thereby enhancing the stability of such packaging cup considerably while nevertheless being able to read the content of the packaging cup at its bottom.

The embodiment may serve the same purpose, in which a bottom blank may represent a simpler and less expensive variant. A further option of reinforcing and/or labeling may be an additional wall blanks or lid blanks. But especially preferred is an embodiment which further improves the labeling and stability of the packaging cup by configuring both as an integral blank.

As mentioned above, a considerable advantage of the reinforcing and/or labeling parts consists in the fact that the parts need not be attached in the course of the packaging cup production, but can be attached retroactively at the user's, i.e., at the filling facility of the packaging cup. The major advantages of reduced stocking both at the manufacturer's and at the user's are obvious. But advantages derive also from the way of fastening the accessory parts. Mechanically locking the accessory parts and blanks which serve the fastening and/or labeling allows their easy removal for separate disposal of the plastic part and the accessory part, or blank. But the configuration may also be such that a gluing of these accessory parts, or blanks, may be limited to only individual, few sealing spots, so that also then the removal of the accessory parts, or blanks, from the plastic part is easily possible.

According to a further exemplary embodiment it may be advantageous to utilize the blank at the same time for closing the opening of the packaging cup. The blank consists in this case preferably of a sealable foil, preferably aluminum foil, which upon opening the packaging cup can be removed completely for disposal.

Despite the good strength of the packaging cup, both in filling, shipping, storage and ultimately also its use, the packaging cup is nonetheless sufficiently flexible to allow crushing it to a minimum volume for disposal, notably upon removal of any cap and/or blank.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
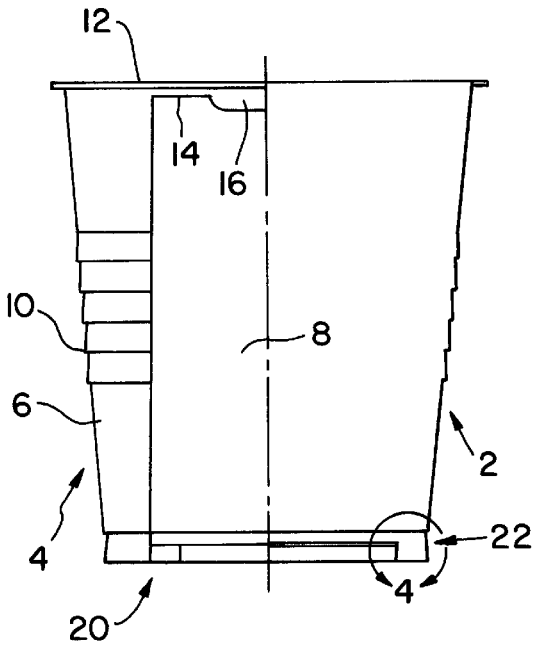
FIG. 1 is a first packaging cup in a view on a flat wall part and as half-side section.
Figure 2:
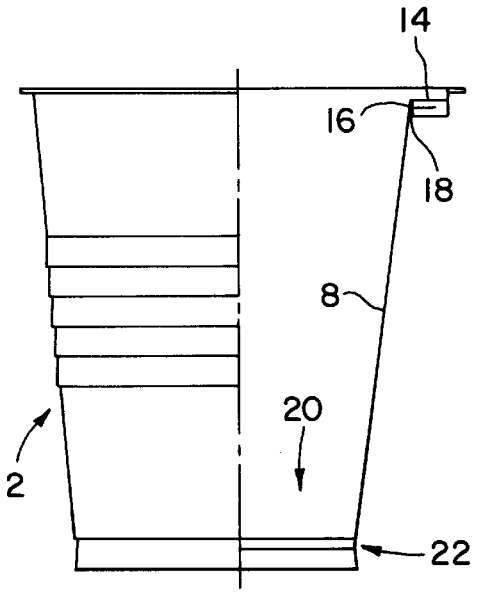
FIG. 2 is the packaging cup relative to FIG. 1 in a view turned 90° and as a half-side section.
Figure 4:
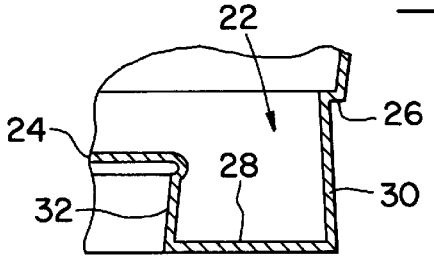
FIG. 4 is a base rim of the bottom of the packaging cup according to FIG. 1, scaled up and in cross section.
Figure 3:
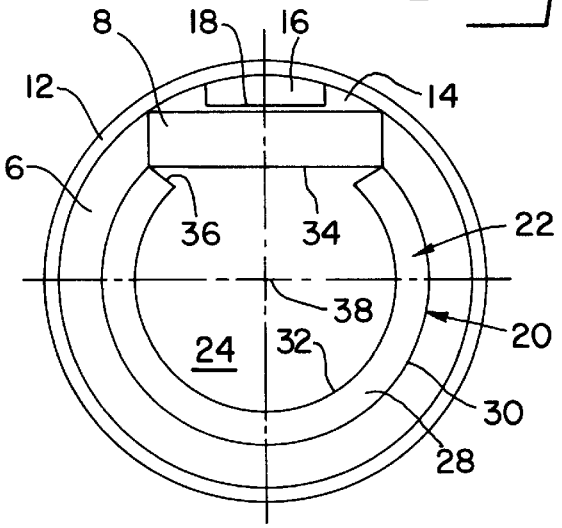
FIG. 3 is the packaging cup relative to FIG. 1 in plan view on its bottom.

In the following figures, identical components for all embodiments are marked using identical references, marking merely modified features using modified references.

LIST OF REFERENCES

| | |
|---|---|
| 2, 2a–2d | Packaging cup |
| 4 | Wall |
| 6 | Round wall part |
| 8, 8a–8d | Flat wall part |
| 10 | Shoulder |
| 12, 12a | Flanged rim |
| 14 | Segment section |
| 16 | Beading |
| 18 | Slot |
| 20 | Bottom |
| 22, 22a | Base rim |
| 24, 24a | Bottom part |
| 26 | Protruding section |
| 28 | Footprint side |
| 30, 32 | Shank |
| 34 | Edge |
| 36 | Front end |
| 38 | Center axis |
| 40 | Base part |
| 42 | Cap |
| 44 | Circumscribing rim |
| 46 | Footprint side |
| 48, 50 | Shank |
| 52 | Bottom part |
| 54, 54a–c | Blank |
| 56, 56a–c | Bottom blank |
| 58, 58a–c | Wall blank |
| 60 | Folding line |
| 62 | Shoulder |
| 64 | Sealing spots |

-continued

| | |
|---|---|
| 66 | Notch |
| 68 | Recess |
| 70 | Link |
| 72 | Score |
| 74 | Closing membrane |
| 76 | Tear-open tab |
| 78, 78b | Lid blank |
| 80, 80a–b | Transitional area |
| 82, 82a-b | Incision |
| 84, 84a–b | Folding line |
| 86, 88 | Tab |
| 90 | Incision |
| 92, 94 | Tab |
| 96 | Incision |

FIG. 1 through 4 show a first packaging cup 2 deep-drawn from a suitable plastic, such as polypropylene, and featuring a wall 4 which comprises a round wall part 6 and a flat wall part 8, corresponding in cross section to a circle, or a circular section, and a chord of the circle. Arranged in the round wall part 6, in its center area, are several surrounding shoulders 10 serving the purpose to improve strength and griping ability. The wall 4 extends at its top end in a round outwardly protruding flanged rim 12 serving to seal to it a closing membrane forming a lid. Molded on, between the flat wall part 8 and the flanged rim 12, is a segment section 14 provided with a downward beading 16 which, for one, serves stiffening purposes and, for another, forms with the flat wall part 8 a slot 18. Moreover, the packaging cup 2 features a bottom 20 comprising a base rim 22 circumscribing at least the round wall part 6, and features a bottom part 24 that is relieved toward the cup interior. The base rim 22 is joined to the round wall part 6 via a protruding section 26. The base rim 22 has a rectangular cross section, as follows particularly from FIG. 4. The base rim 22 also includes a footprint side 28 which by way of a first shank 30 is joined to the protruding section 26. A second shank 32 establishes the connection to the bottom part 24. The configuration now is such that the base rim 22 tapers with its shanks 30, 32 toward the wall 4, thus forming quasi-backoffs, or reliefs, enabling a locking of accessory parts, as will be described in more detail hereinafter. The bottom part 24 extends via an edge 34 in the flat wall part 8. The base rim 22 terminates on the edge 34, featuring there end faces 36 that are aligned approximately radially to the center axis 38 of the packaging cup 2. Already the packaging cup described in FIGS. 1 through 4 has favorable properties, since it possesses, despite minimum material consumption, and despite being optimally thin-walled, nonetheless sufficient strength for filling, storage and shipping and use by the consumer.

A favorable improvement of the packaging cup relative to FIG. 1 is illustrated in FIGS. 5 through 8. The packaging cup 2*a* relative to FIGS. 5 through 8 differs from the one relative to FIG. 1 in that, for one, the base rim 22*a* forms a complete circle and, thus, overlaps also the transition between the bottom part 24*a* and the flat wall part 8*a* with a straight base part 40. The bottom is provided with a cap 42 adapted to the shape of base rim 22*a*. Consequently, the cap 42 has a surrounding rim 44 with a footprint side 46 matching the footprint side 28 of the base rim 22*a*. The side shanks 48, 50 match the shanks 30, 32 of the base rim and lock with it on account of the tapered configuration of the base rim 22*a*. Additionally, the cap 42 contains a bottom part 52 that is arranged within the surrounding rim 44 and, as the case may be, may be labeled. To that end, the cap 42 itself may be colored and labeled or, however, may consist of clear plastic, in which case then a labeled insert (not illustrated) may be placed between the bottom part 52 of the cap 42 and the bottom part 24*a* of the packaging cup 2*a*. The cap 42 is preferably made and custom-fabricated independently of the cup part, and attached at the customer's filling facility. Hence, the cup part can be produced user-neutral and optimally stored both at the manufacturer's and the user's. Only the cap 42 must be produced brand-specifically and can be attached at the user's during or after filling. Deriving thereof are considerable savings in the production and storage of the packing cup both to the manufacturer and the user. The cap 42 can be attached merely by snapping it to the bottom or additionally with the aid of sealing spots (not illustrated).

Figure 14:
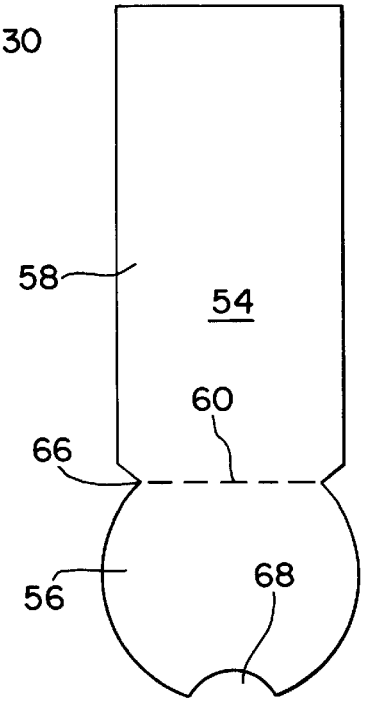
FIG. 14 is a blank for the packaging cup according to FIG. 9.
Figure 5:
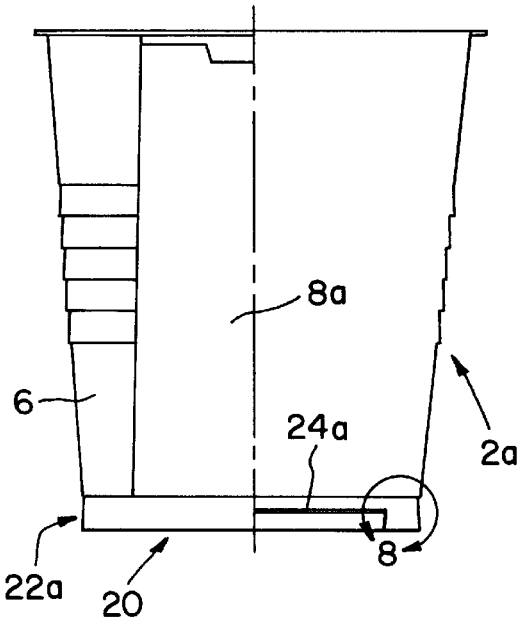
FIG. 5 is a further packaging cup with a cap assembled to the bottom, in a view on the flat wall part and as a half-side section.
Figure 6:
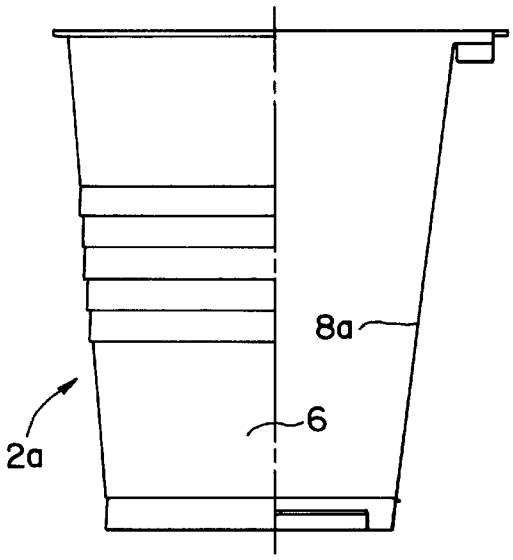
FIG. 6 is the packaging cup according to FIG. 5 in a view turned 90° and as a half-side section.
Figure 8:
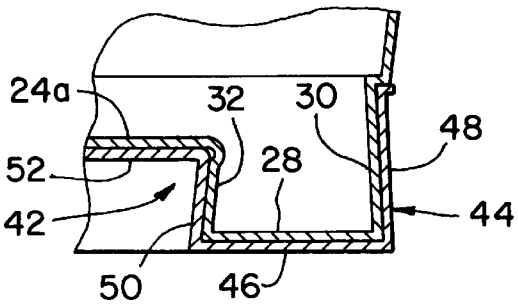
FIG. 8 is a scaled up view of the base of the bottom as a cutout and cross section.
Figure 7:
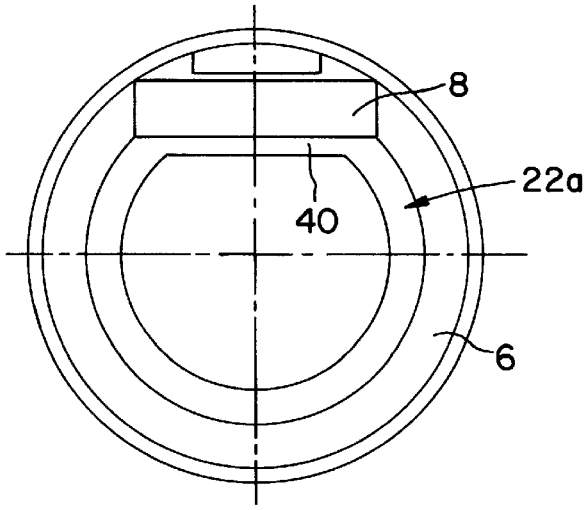
FIG. 7 is the packaging cup of FIG. 5 as a plan view on its bottom.
Figure 12:
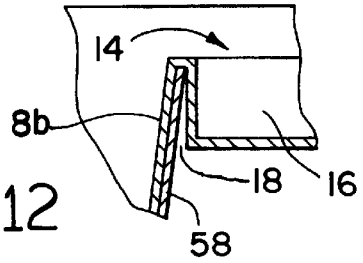
FIG. 12 is the top end of the flat wall part as a scaled-up cutout.
Figure 9:
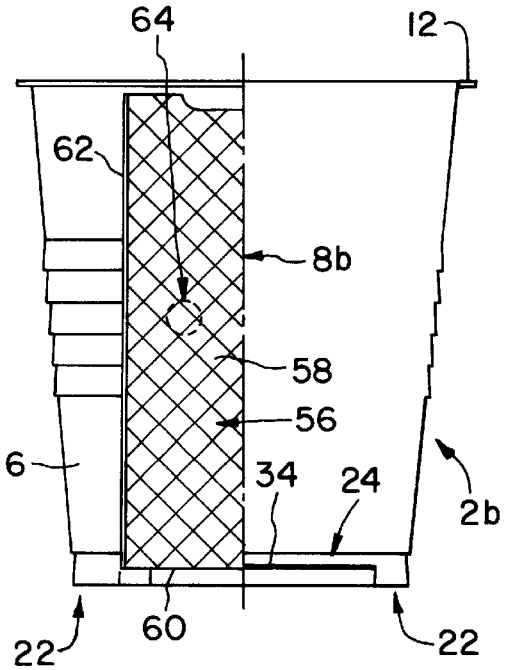
FIG. 9 is a further packaging cup with a blank assembled to it, as a view on the flat wall part and as a half-side section.
Figure 10:
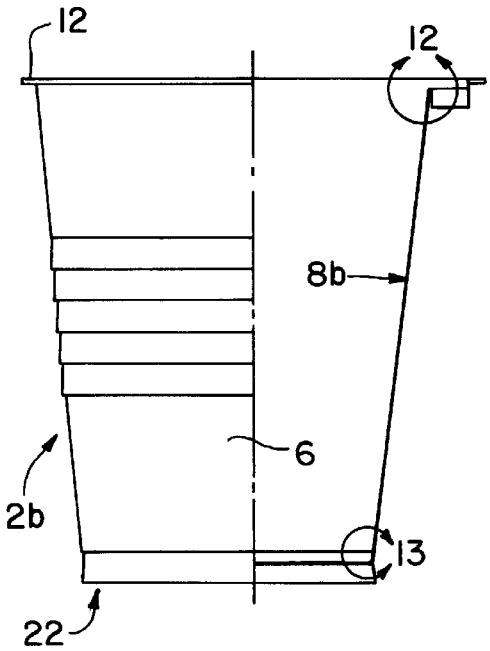
FIG. 10 is the packaging cup of FIG. 9 in a view turned 90° and as a half-side section.
Figure 11:
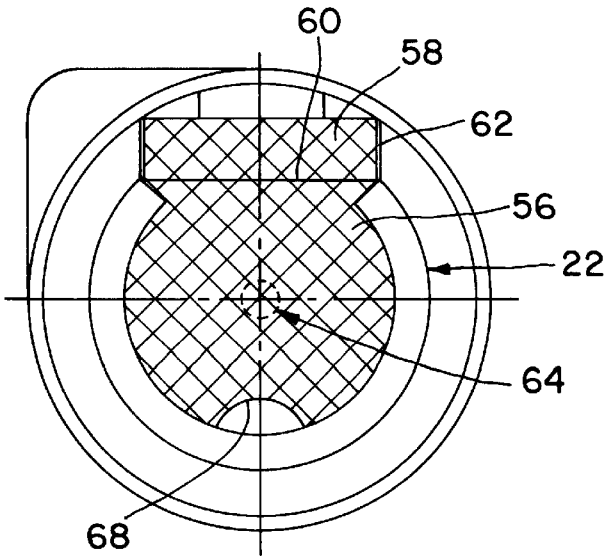
FIG. 11 is the packaging cup of FIG. 9 in a bottom view.
Figure 13:
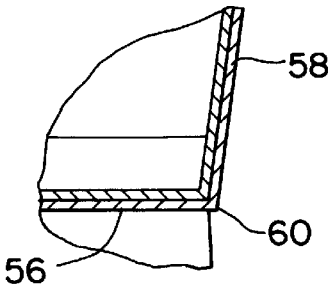
FIG. 13 is the bottom end of the flat wall part as a scaled-up cutout.

FIGS. 9 through 14 describe a further packaging cup 2*b* that corresponds to the packaging cup relative to FIGS. 1 through 4, but is provided, for labeling and/or reinforcement, with a blank 54 of random material, preferably cardboard. Blank 54 consists of a bottom blank 56 that matches the bottom part 24 and locks in between the base rim 22, and of a wall blank 58 coordinated with the flat wall part 8*b*. The bottom blank 56 and wall blank 58 form between themselves a folding line 60 that is coordinated with the edge 34 between the bottom part 24 and the flat wall part 8*b*. The flat wall section 8*b* forms at the transition to the round wall part 6 a shoulder 62 which backs the flat wall part 8*b* off by about the thickness of the blank 54. At the top end, the wall blank 58 is inserted in the slot 18 between the beading 16 and the flat wall part 8*b*. A sufficient grip of the blank 54 on the cup part is thereby given already. Additionally, sealing spots 64 may be placed on the bottom part 24 and flat wall part 8*b* for gluing the blank in place. A blank of the type being used is illustrated in FIG. 14, containing along the folding line 60 between the bottom blank 56 and wall blank 58 notches 66 coacting with the ends of the base rim 22. Also provided on the bottom blank 56 is a recess 68 allowing for gripping and removal of the blank attached to the packaging cup for disposal, that is, to dismantle the packaging cup down to its components. Owing to its being thin-walled, the packaging cup already can be crushed for volume reduction, said crushing being further facilitated by removal of blank 54.

Figure 15:
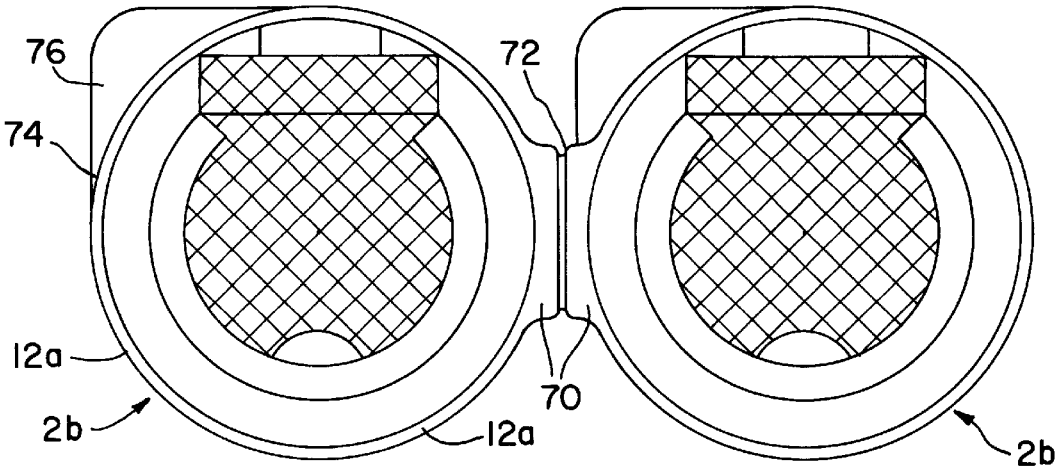
FIG. 15 is two packaging cups relative to FIG. 9 joined to form a unit, in a bottom view.
Figure 16:
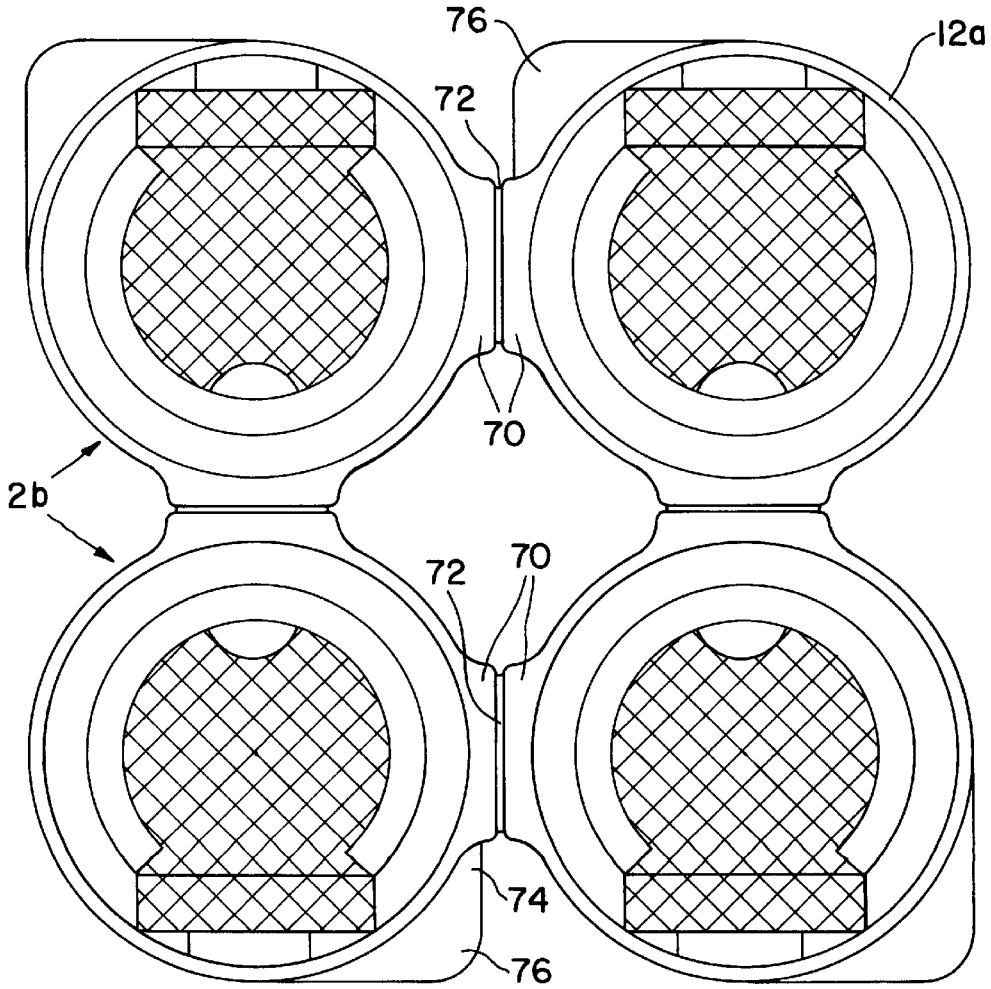
FIG. 16 is four packaging cups relative to FIG. 9 joined to form a unit, in a bottom view.

FIGS. 15 and 16 show further variants depicting how a packaging cup 2*b*, relative to FIGS. 9 through 14, can be assembled in a set of two or a set of four. The surrounding flanged rim 12*a* features for that purpose, links 70 connecting by way of scores 72 to the corresponding link 70 of an adjacent packaging cup. Visible in FIGS. 15 and 16 are also closing membranes 74 with their tear-off tabs 76, sealed to the flanged rims 12*a*.

Figure 18:
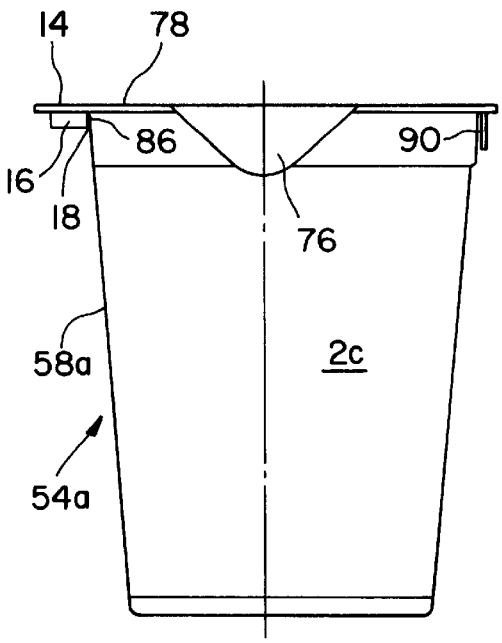
FIG. 18 is a further packaging cup with a blank, in a view on its flat wall part and offset 90° thereto.
Figure 17:
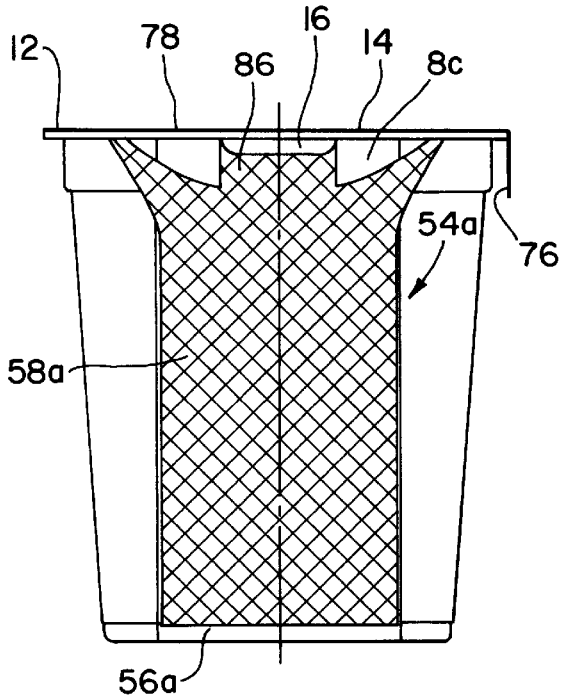
FIG. 17 is a further packaging cup with a blank, in a view on its flat wall part and offset 90° thereto.
Figure 19:
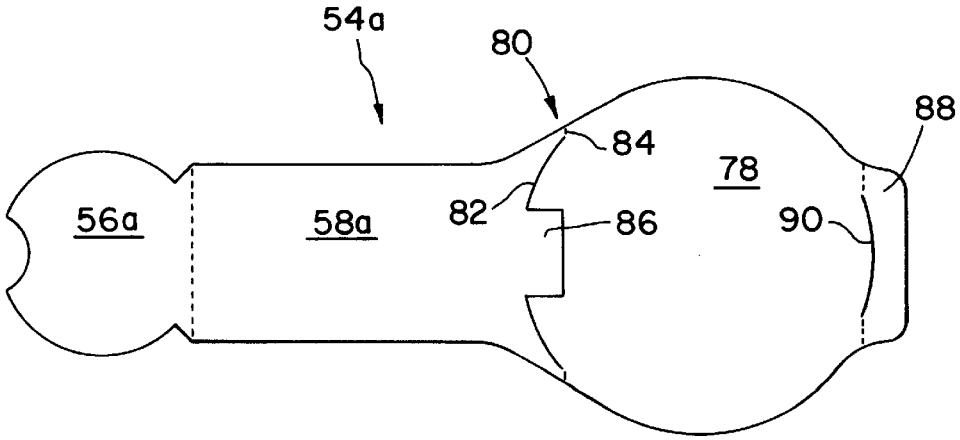
FIG. 19 is a blank of the packaging cup relative to FIG. 17 and 18 in a plan view.

FIGS. 17 through 19 show a further packaging cup 2*c* configured analogous to the packaging cups described above, but featuring a modified blank 54*a* that is formed integrally of a bottom blank 56*a*, a wall blank 58*a* and a lid blank 78. The blank 54*a* features in the transitional area between the wall blank 58*a* and lid blank 78, in the transitional area 80, an incision 82 on which border folding lines 84 are created on both sides. The incision 82 is shaped such that a tab 86 forms on the wall blank 58*a*, said tab engaging the slot 18 between wall part 8*c* and beading 16 so as to improve the mechanical locking of the blank 54*a* to the packaging cup 2*c*. The further tab 88 with an incision 90, on the side of the lid blank 78 away from the wall blank 58*a*, acts in the same sense. The flanged rim 12 engages here the incision 90, and the tab 88, folded over, prevents the lid blank 78 from opening. The blank 54*a* consists, in this exemplary embodiment, preferably of cardboard, which may be laminated with plastic or a metal foil and serves for labeling and/or stabilization of the packaging cup. The blank 54*a* overlaps with its lid blank 78, the closing membrane 74, which seals the opening of the packaging container and includes a tear-open tab 76.

Figure 21:
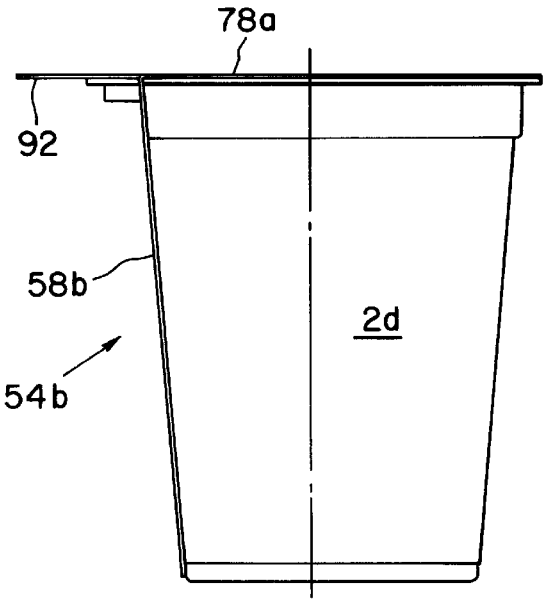
FIG. 21 is another packaging cup with a blank, in a view on its flat wall part and offset 90° thereto.
Figure 20:
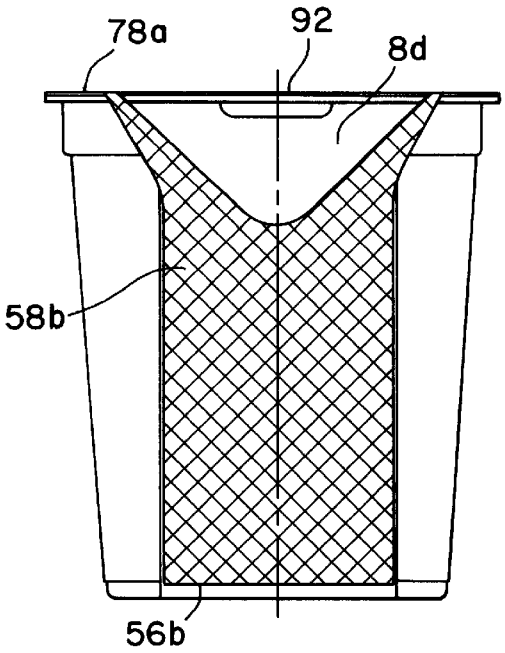
FIG. 20 is another packaging cup with a blank, in a view on its flat wall part and offset 90° thereto.
Figure 22:
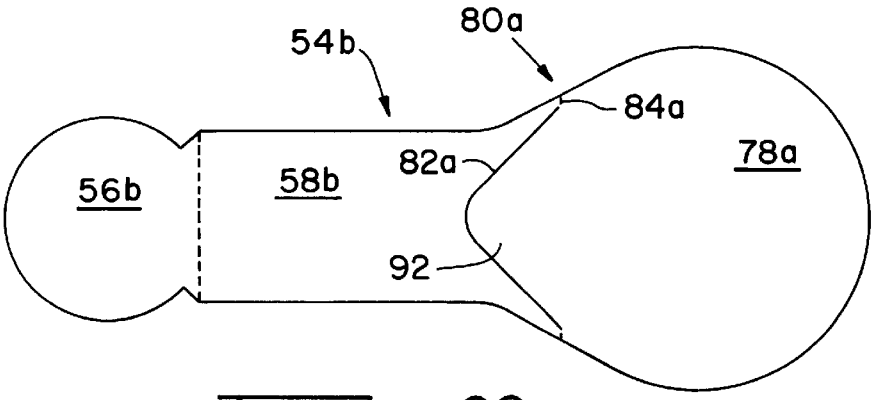
FIG. 22 is a blank of the packaging cup relative to FIG. 20 and 21, in plan view.

In the exemplary embodiment relative to FIGS. 20 through 22, the single-piece blank 54*b* consists again of a bottom blank 56*b* on which borders a wall blank 58*b* and, via the transitional area 80*a,* a lid blank 78*a.* The blank contains in the transitional area 80*a,* again, an incision 82*a* configured such that the lid blank 78*a* has on both sides of the folding line 84*a,* a tab 92 that protrudes beyond the flanged rim 12. The blank 54*b* is in this example formed of a material which at the same time serves to seal the opening of the packaging cup, thus making special measures for that purpose dispensable. Consequently, the blank 54*b* may consist, e.g., of a thin plastic foil or, specifically, an aluminum foil. The tab 92 protruding beyond the flanged rim 12 serves as a tear-open tab for the lid blank 78*a,* to open the packaging cup. The blank 54*b* in the present example is preferably glued to the packaging cup in a manner (not illustrated) via the wall blank 58*b* and the bottom blank 56*b.*

Figure 23:
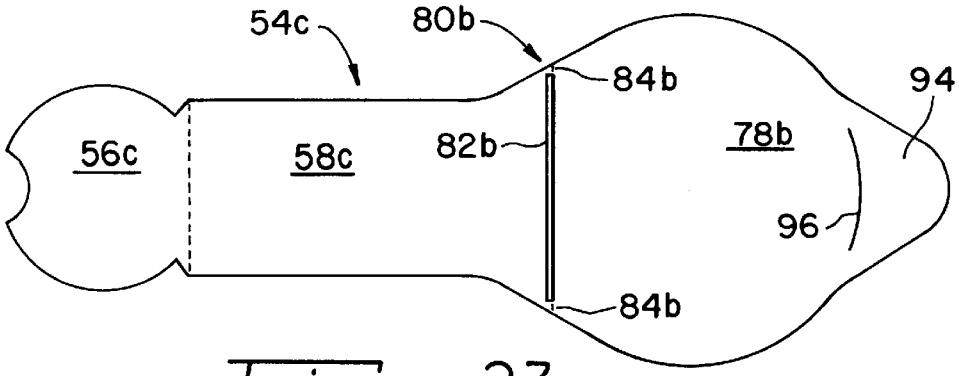
FIG. 23 is a further blank in plan view.

FIG. 23 shows a further blank 54*c* with a bottom blank 56*c* on which borders the wall blank 58*c* and which extends again, via a transition area 80*b,* in a lid blank 78*b.* The blank 54*c* has in the transition area 80*b* again an incision 82*b* that terminates between two folding lines 84*b* and has a width such that the blank 54*c* can be readily slipped over the flanged rim 12 with beading 16. On the side away from the wall blank 58*c,* the lid blank 78*b* is provided again with a tab 94. The blank 54*c* may consist either of cardboard and may be arranged over a closing membrane of a packaging cup or may be directly configured for sealing the opening of the packaging cup 2*d.* In the latter case, the tab 94 can then be directly used as a tear-open tab for the lid of the packaging cup. With the blank 54*c* serving merely as labeling and reinforcement means and formed of cardboard, an incision 96 is preferably contained between the lid blank 78*b* and the tab 94, and the fold-over of the tab 94 may serve to lock blank 54*c,* as has been described already with the aid of the example relative to FIGS. 17 through 19.

In supplementing the illustrated exemplary embodiment, the packaging cups may be provided with more than one flat wall part, specifically two flat wall parts, offset 180° relative to each other, being of advantage. The base rim suitably features, per flat wall part, a recess allowing a blank then to extend integrally from one flat wall part across the bottom to the other flat wall part.

As already mentioned above, the blank may consist either of cardboard, which may be coated or laminated and serve the labeling and/or reinforcement of the packaging cup. Such blank may be joined to the packaging cup strictly mechanically by appropriate locking to the bottom and flanged rim of the packaging cup. However, the blank may also be glued, additionally or exclusively, to the packaging cup. The latter applies particularly with a blank consisting of a thin foil, e.g., of plastic or aluminum. The blank may serve strictly labeling functions and/or, additionally, as reinforcement of the packaging cup and/or directly for sealing it.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

I claim:

1. A deep drawn plastic packaging cup comprising:

a wall having a bottom, a round cross section wall part being one of cylindrical and truncated cone-shaped, and a round radially protruding outward flanged top rim;

a flat wall part extending through a chord of the round cross section of said wall;

a circular segment section formed with said top rim and joined to said flat wall part; and said segment section includes a downward beading forming a slot with said flat wall part.

2. The packaging cup according to claim 1 in which said round wall part includes reinforcement shoulders.

3. The packaging cup according to claim 1, said round wall part which tapers conically downward, said flat wall part having a constant width across its entire length.

4. The packaging cup according to claim 1 further comprises an insertable blank; said flat wall part is at the transition to said round wall part set inward by a shoulder corresponding approximately to the thickness of said insertable blank.

5. The packaging cup according to claim 1 in which said bottom includes a base rim circumscribing at least said round wall part, and a bottom part backed off toward the cup interior.

6. The packaging cup according to claim 5, in which said base rim includes a base part extending along said flat wall part.

7. The packaging cup according to claim 5 in which said base rim is joined at least to the round wall part by a protruding section.

8. The packaging cup according to claim 5 in which said base rim includes a rectangular cross section which tapers toward said wall and to said bottom part.

9. The packaging cup according to claim 5 in which said base rim terminates at said flat wall part and includes end faces extending approximately radially to a center axis of said packaging cup.

10. The packaging cup according to claim 5 further comprising a cap configured to match the shape of said bottom, said cap attached to said bottom.

11. The packaging cup according to claim 5 further including a bottom blank inserted in said backed-off bottom part.

12. The packaging cup according to claim 1 further comprising a wall blank shaped to match the shape of said flat wall part.

13. The packaging cup according to claim 1 including a lid blank which seals said top rim.

14. The packaging cup according to claim 11 further comprises an integral blank including at least two of the following:

a wall blank; and a lid blank.

15. The packaging cup according to claim 14, in which said integral blank features in the transition area between said wall blank and said lid blank an incision.

16. The packaging cup according to claim 15, in which said incision is formed such that it allows said flanged top rim to traverse therethrough.

17. The packaging cup according to claim 15, wherein said flat wall part, said incision formed such that said wall blank includes a tab engaging said slot.

18. The packaging cup according to claim 15, in which said incision is formed such that said lid blank has a tear-open tab.

19. The packaging cup according to claim 15 in which said lid blank includes on the side away from said wall blank a further incision for said flanged top rim.

20. The packaging cup according to claim 11 in which said blank is formed of cardboard.

21. The packaging cup according to claim 11 in which said blank contains a foil.

22. The packaging cup according to claim 11 in which said blank is attached to a respective part of said packaging cup.

23. The packaging cup according to claim 15 in which said blank is formed of cardboard.

24. The packaging cup according to claim 14 in which said blank contains a foil.

25. The packaging cup according to claim 14 in which said blank is attached to a respective part of said packaging cup.

* * * * *